US008827314B2

(12) United States Patent
Plaschka et al.

(10) Patent No.: US 8,827,314 B2
(45) Date of Patent: Sep. 9, 2014

(54) SECURITY DOCUMENT

(75) Inventors: Reinhard Plaschka, Windach (DE); Georg Depta, Rosenheim (DE)

(73) Assignee: Giesecke & Devrient GmbH, Munich (DE)

( * ) Notice: Subject to any disclaimer, the term of this patent is extended or adjusted under 35 U.S.C. 154(b) by 1300 days.

(21) Appl. No.: 10/521,231

(22) PCT Filed: Jul. 15, 2003

(86) PCT No.: PCT/EP03/07658

§ 371 (c)(1),
(2), (4) Date: Sep. 8, 2005

(87) PCT Pub. No.: WO2004/009371

PCT Pub. Date: Jan. 29, 2004

(65) Prior Publication Data

US 2006/0145468 A1 Jul. 6, 2006

(30) Foreign Application Priority Data

Jul. 18, 2002 (DE) ..... 102 32 786
Oct. 11, 2002 (DE) ..... 102 47 591

(51) Int. Cl.
*B42D 15/00* (2006.01)
*B41M 5/26* (2006.01)
*B41M 3/14* (2006.01)

(52) U.S. Cl.
CPC ..... *B42D 15/0013* (2013.01); *B41M 5/26* (2013.01); *B42D 2031/16* (2013.01); *B41M 3/14* (2013.01); *B42D 2035/28* (2013.01); *B42D 2035/50* (2013.01); *B42D 2031/08* (2013.01)
USPC ..... 283/72; 264/446; 264/482; 162/95

(58) Field of Classification Search
USPC ..... 283/57, 72; 264/446, 482, 400; 162/134, 117, 140
See application file for complete search history.

(56) References Cited

U.S. PATENT DOCUMENTS

| | | | | | |
|---|---|---|---|---|---|
| 3,880,706 | A | * | 4/1975 | Williams | 162/103 |
| 4,507,346 | A | * | 3/1985 | Maurer et al. | 428/158 |
| 4,544,181 | A | | 10/1985 | Maurer et al. | |
| 4,740,269 | A | * | 4/1988 | Berger et al. | 427/228 |
| 4,766,026 | A | | 8/1988 | Lass et al. | |
| 4,988,126 | A | * | 1/1991 | Heckenkamp et al. | 283/92 |
| 5,990,444 | A | * | 11/1999 | Costin | 219/121.69 |
| 6,082,778 | A | * | 7/2000 | Solmsdorf | 283/82 |
| 6,395,191 | B1 | | 5/2002 | Schell | |
| 2002/0122931 | A1 | * | 9/2002 | Brownfield et al. | 428/324 |
| 2004/0050269 | A1 | * | 3/2004 | Adamczyk et al. | 101/150 |
| 2004/0239097 | A1 | * | 12/2004 | Boehm et al. | 283/57 |

FOREIGN PATENT DOCUMENTS

| | | | | | |
|---|---|---|---|---|---|
| DE | 28 36 529 | A | | 3/1979 | |
| DE | 197 32 860 | A | | 2/1999 | |
| EP | 0 520 060 | | | 7/1992 | |
| EP | 0526396 | A1 | | 2/1993 | |
| EP | 0678400 | A1 | | 10/1995 | |
| GB | 2 316 909 | A | | 3/1998 | |
| WO | WO 97/18092 | A | | 5/1997 | |
| WO | WO/9803348 | | * | 1/1998 | B42D 15/00 |

* cited by examiner

*Primary Examiner* — Kyle Grabowski
(74) *Attorney, Agent, or Firm* — Rothwell, Figg, Ernst & Manbeck, P.C.

(57) ABSTRACT

The invention relates to a document of value, such as e.g. a bank note or the like, which has a security paper. In the security paper at least one tangible marking in the form of a relief structure is produced by a laser.

36 Claims, 5 Drawing Sheets

SECURITY DOCUMENT

CROSS-REFERENCE TO RELATED APPLICATION

This application is a National Phase of International Application Serial No. PCT/EP03/07658, filed Jul. 15, 2003.

FIELD OF THE INVENTION

The invention relates to a document of value with a security paper and a security paper with a tactilely detectable marking and a method for producing the document of value or the security paper.

DESCRIPTION OF THE BACKGROUND ART

Bank notes, checks, tickets, admission tickets and other documents of value, in particular made of paper, for the purpose of forgery-proofness are equipped with security features, with the help of which the authenticity of the documents of value is checkable.

In this context there has been proposed to apply markings to a document by means of laser radiation, so as to thereby achieve an irreversible and visually easily detectable alteration of the document. For example in DE 28 36 529 C2 it is proposed to burn out the serial number from an ink layer by means of an appropriately controlled laser beam. In EP 0 918 649 B1 it is proposed to repeat the identification number at a different place of the document by a local reduction of the document thickness by means of laser etching. In the two above-mentioned cases the material is removed by means of laser radiation.

In contrast to that other approaches to the problem provide, that the substrate material is merely blackened by means of laser radiation. As to achieve particularly well readable and sharp-edged markings, it is also known to admix absorbents and carbon forming agents to the paper, for example micro-ground plastics (DE 197 32 860 A1).

DE 198 22 605 A1 takes a different path. Therein it is proposed that the paper substrate surface at first is treated with laser energy, so as to structurally alter the surface, and to subsequently provide this surface with an opaque coating, for example by printing, lacquering and/or metalizing. The prior alteration of the surface leads to a noticeable alteration of the ink density, the ink location, the luster and/or the reflection in the subsequently applied coating, the result of which is a visible security feature.

The above-mentioned security features all are visually noticeable security features. But there exists a basic need for further, new security features, in particular for security features, which are perceptible for another sense organ, for example detectable with the sense of touch, i.e. tactile security features.

SUMMARY OF THE INVENTION

Therefore, it is the problem of the present invention to propose a document of value with a tactilely detectable security feature and in particular a method for producing such a security feature on a document of value.

This problem is solved by the features described herein. Advantageous developments also are described herein.

According to the invention a document of value made of security paper is marked by means of a laser, so that a tangible marking in the form of a relief structure is formed.

It has turned out that with a respective adjustment of the composition of the security paper and the inscription parameters, such as kind of laser used, laser power, operation mode of the laser, wavelength etc., a relief-like structure can be achieved in the security paper, the said relief-like structure being tactilely detectable.

According to a special embodiment of the invention the laser marking also leads to a colour change or a colour alteration of the security paper in the marked area. Due to the clear contrast to the surroundings an easy check by the human eye or by an image processing device is possible. The kind and the colour tone of the colour alteration depends on the composition of the security paper used. Preferably, for the inventive documents of value security papers are used, in which the laser inscription produces a light-grey to black marking.

This colour change or colour alteration can be intensified by suitable additives, which can be contained in the security paper. The kind of additives used depends on the kind of laser used or the laser wave length used. Thinkable are laser-radiation-absorbing additives, such as for example carbon black, thermochromic substances, laser iriodine of the Merck company or titanium dioxide.

If this blackening of the security paper is not desired, the security paper can again be moistened before the inscription process. By this means the grey to black appearance disappears. The tactility of the marking is not impaired by this. The result is a visually not or only hardly perceptible marking, which, however, is tangible very well.

As a security paper preferably papers are used, which at least contain proportions of fibers of annual plants, such as cotton, linter, flax or something similar. In particular those security papers are suitable, which contain only cotton fibers or a mixture of cotton fibers and plastic fibers. Preferred is a plastic fiber proportion of about 12 wt. % related to the total weight of the security paper.

Particularly good results are achieved with cotton vellum paper with an average fiber length of 1 millimeter. These papers contain $TiO_2$ as filling material, which absorbs at a wavelength of 1064 nanometer and in particular is employed for adjusting the opacity and for suppressing luminescence emissions of the paper. As a sizing for these cotton vellum papers preferably polyvinyl alcohol (PVA) is used.

The security paper can also have a multilayer form. For example, the security paper can consist of two paper layers, between which any different layer is disposed, such as an ink layer, metal layer or foamable layer. The foamable layer supports the formation of the tangible marking, by the laser beam. Such foamable layers can contain e.g. black powder or blowing agents, which upon the action of heat generate gas, or hollow chamber balls, which contain a gas expanding upon the action of heat. These foaming additives, however, can also be added directly to the paper or to one of the layers of a multilayer security paper. Alternatively, it is also possible to mix these additives to the surface sizing of the security paper.

For the laser inscription of such security papers preferably pulsed Nd:YAG lasers with a wavelength of 1064 nanometer are used. Depending on the desired relief structure or the desired degree of blackening and/or the line thickness of the information to be shown, other laser types and/or wavelengths or inscription parameters may be expedient. For example, frequency-doubled or frequency-tripled Nd:YAG lasers can be used in pulsed or in continuous wave mode. Also $CO_2$ laser or excimer laser can be used.

With cotton vellum papers preferably Nd:YAG lasers are used operating at the fundamental wavelength of 1064 nanometer with an average power of 65 W and a modulation frequency of about 10 kilohertz. With these settings the speed, with which the laser is moved over the paper, is between 330 and 1350 millimeter per second, the diameter of the laser beam incident on the paper measuring about 120 μm. The speed, however, can even be further increased to values of up to 2700 millimeter per second. In this case, however, the modulation frequency of the laser has to be increased to about 12 kilohertz. The inscription speed strongly depends on the energy per unit area necessary for the production of a tangible marking. With untreated cotton vellum papers this energy per unit area amounts to at least 0.31 joule per square millimeter. This value, however, can be changed by respective additives in the paper, in particular it can be reduced, so that higher inscription speeds become possible.

The height of the tangible relief in relation to the surface of the document of value depends on the inscription speed. At medium to high speeds relief heights of 30 to 80 μm can be obtained. At slow speeds relief heights of 100 μm can be realized. Here a compromise between desired relief height and economical inscription speed has to be selected.

The line width and thus the resolution of the tangible marking upwardly is limited by the diameter of the laser beam, i.e. the resolution maximally corresponds to the diameter of the laser beam. But in many applications, however, a line width of about 200 to 600 μm is sufficient.

The marking parameters can be adjusted in such a way, that the relief structure within the marking has different relief heights and/or different degrees of blackening. The producible relief height here can be increased or decreased step-by-step or continuously. In this way direction-dependent, tangible markings can be produced. I.e. depending on the direction from which one strokes the marking, the relief is more or less tangible.

The relief height of the marking can also be increased by a multiple irradiation of the same place with laser radiation. Furthermore, laser beam and document of value or security paper to be inscribed not necessarily have to be disposed perpendicular to each other. The laser beam can enclose any angle with the paper.

For producing an information according to the invention also different laser energies can be used, so that within the information different relief heights and/or different blackenings are the result. In case, for example, a two-dimensional code is produced in this way, by the different blackening a three-dimensional code can be produced. I.e. the degree of blackening is used as a further coding level, which e.g. can be evaluated with appropriate detectors.

By means of the laser marking alphanumeric characters can be shown, for example serial numbers of the documents of value or any codes, such as for example one-dimensional or two-dimensional bar codes or blind codes, any symbols or images. Any alphanumeric characters, such as date, time, batch designation, or writings, such as the signature of a Minister or the President of the Central Bank, are possible, too.

Of course, any geometric patterns can also be produced, such as for example a knobbed structure. The tactile knobs due to the relatively small laser focus can be produced very small, i.e. with a small diameter, and a, compared to the diameter, high elevation above the surface of the document. This kind of marking, which has a highly resolved structure with an at the same time high relief, i.e. high tactility, cannot be imitated by printing technology.

According to a further embodiment also the surroundings of an information to be shown can be designed in a tactile fashion, while the information itself is non-tactile. I.e., the information has the form of a negative representation.

The marking can have the form of an information visually noticeable without any auxiliary means, or a microwriting clearly noticeable only with the help of a magnifying glass. The tangible marking can be disposed without significant restrictions at any place of the surface of the document of value or at several places of the document of value.

Furthermore, the markings inventively produced with a laser can complement markings produced in another way and thus form a new security element. For example, a coloured line print can be combined with an inventively produced line relief in such a way that the coloured lines come to lie on the flanks of the relief. Varying viewing angles render different visual impressions, which is due to shadowing effects.

If several markings are applied to a document of value, these markings can be identical or different in content. Alternatively, the markings can have any connection to each other or to information that is produced by a different method on the document, and thus contribute to a further improvement of the forgery-proofness. For example, a check digit calculated from the serial number of the document of value can be lasered.

The inventive document of value is any document, the substantial component of which is a security paper, such as for example a bank note, a check, a visa, a label, a passport page or another document to be secured made of security paper. Within the framework of the invention the document of value can also consist of a paper/foil composite, wherein the access to the area of the security paper carrying the tangible laser marking preferably should be unimpeded, so as to ensure the tactile checkability. This can be effected by the document of value or the security paper having a foil only on the side facing away from the marking, or by leaving blank the marking area in the foil in the form of a window. Here it can be useful to extend the laser inscription beyond the borderline area between paper and foil. Dependent on the inscription parameters used the foil is merely blackened or additionally broken up, so that a further tangible relief is the result.

It also has turned out that the tangible marking can be overprinted without the tactility being lost. If the marking is provided e.g. with a metallic overprint, special light/dark effects are the result, depending on the reflection of the metal-coloured layer. If the printing ink when viewed from a certain viewing angle appears bright due to the specular reflection, then the diffusely scattering, tangible marking can be noticed as a dark information in front of this bright background and vice versa.

Alternatively, the tangible marking can also be overprinted with a printing ink that has the same colour tone as the tangible marking produced with the laser. If for example for the production of the tangible marking a Nd:YAG laser working in the infrared spectral region is used and the tangible marking has a grey appearance, then this marking can be overprinted with a grey printing ink as to form a camouflage for visibility.

The inventive document of value can have further security features, such as for example a security thread, an optically variable security element, a security print, or machine-readable security features, such as for example luminescent or magnetic substances. In case the document of value has a security thread, the inventive laser marking can be provided in the area of the security thread. In case the security thread is quasi-woven into the document of value as a so-called "window security thread", i.e. the security thread becomes visible in some places directly on the surface of the document of value, the laser marking can be provided in those intermediate areas, in which the security thread is embedded into the document of value. Alternatively, the marking can extend beyond the foil/paper borderline area as mentioned above, so that the security thread, too, carries a laser marking. A marking of the security thread exclusively in the window area is also possible. The inventive documents of value can also be used for the protection of products of any kind.

According to a special embodiment the inventive tangible marking can be combined with other tactile security elements, such as an intaglio printing. Here it is made use of the different tactilities. The relief produced by the intaglio printing forms a hard or sharp junction to the surroundings, while the inventive marking has a soft junction and a soft, velvety tangible surface.

For example, the tactile intaglio printing marking can constitute the frame for a coloured, not tangible field, which preferably has the same colour as the tactile edge and likewise is produced by means of intaglio printing. If this colour absorbs laser radiation, it is ablated when exposed to the laser and at the same time the tangible laser marking can be formed. The laser marking, however, can also be produced without an ablation of the ink layer. This coloured area additionally can be underlaid with a primer layer, which contains luminescence substances and/or positively influences the removal properties of the colour to be ablated and/or positively influences the durability if the colour not to be removed.

According to a further embodiment the printing ink disposed in the area of the laser marking can have magnetic or conducting properties or can have the form of a light-emitting organic semiconductor layer (OLED). The subsequent laser inscription causes disturbances in the machine-measurable signal of the individual layers, which can serve as a further authenticity feature. These disturbances e.g. can represent individualizing information, such as the serial number. In this way the visible and tangible laser marking is adapted to be checked by machine.

According to a further variant the security paper or document of value can be provided with a coating, which contains carbon black and hollow chamber balls. During the inventive laser inscription the laser radiation is absorbed by the carbon black content and a visible blackening is the result. At the same time the hollow chamber balls expand or are destroyed under the generation of gas, so that a well tangible relief arises. In the blackened area then no more hollow balls are present. However, in the area of the flanks of the laser marking there still exist inflated, not-destroyed hollow balls, which diffusely scatter the light and constitute a contrast to the surroundings. When tilting the document or security paper, additionally a contrast reversal occurs, which is due to the different reflecting properties of the flanks and the areas surrounding the flanks.

According to a special embodiment the document of value has an additional coating in the area of the inventive tangible marking. The laser marking can be present in the area of the coating completely or only partially. This additional coating can be any printed image, such as alphanumeric characters, logos, patterns, guilloches etc., an all-over applied colour layer or lacquer layer or a multilayer security element, such as a diffractively acting structure observable in reflected light. I.e., the coating can be printed, vapor-deposited, sprayed or transferred by transfer method. Preferably, the laser inscription is incorporated into optically variable printed layers, such as printed layers containing liquid-crystalline pigments or interferential-layer pigments, or metallic layers e.g. made of aluminum, silver or gold.

When the coating is transparent for the laser radiation used, upon appropriate selection of the inscription parameters the tangible marking is produced in the security paper therebelow, the said marking at the same time bulging out the coating without destroying it. In case the coating is light-transmitting and the laser marking causes a colour-change in the security paper, the said colour-change is visible in addition to the tangible relief of the inventive marking. If the coating is a coloured printed image or an ink layer, their colour effects can be affected by the marking therebelow, i.e. a colour change of the security paper. In this way a visually noticeable marking differing from the surroundings in colour tone can be produced in a coloured surface beside a tangible marking.

If, however, absorbing coatings are used, which absorb the laser radiation, then before or at the same time with the actual marking of the security paper a partial or complete removal of this coating takes place. In this case, too, the marking is visually noticeable, since in this area the coating was removed.

According to a special embodiment of the invention the coating consists of a multilayer security element applied to the security paper or document of value, for example, in the form of a label or a transfer element. In the simplest case the security element shows the following layer sequence as seen from the viewer's position: a plastic layer, preferably a lacquer layer, a metal layer, such as a thin aluminum layer, and an adhesive layer for fastening the security element to the security paper or document of value. The lacquer layer additionally can have an embossing, which produces visually observable diffractive effects, such as a hologram or any diffraction grating image. When marking with a laser, preferably a Nd:YAG laser, the metal layer is removed area-wise. At the same time the marked security paper bulges out the foil layer structure of the security element, so that the tangible marking is the result. Depending on the selection of the inscription parameters, the lacquer layer of the security element is not removed, hardly removed or completely removed by this operation. When respectively selecting the marking parameters, the security paper at the same time is blackened. This blackening is visible well through the transparent area of the security element from which the metal layer was removed. The marking parameters can be adjusted in such a way, that the area, from which the metal layer is removed, is larger than the partial area provided with a tangible marking.

Since the tactilely detectable laser-marked area in this embodiment is surrounded by an extremely smooth area, the tactility of the security feature is additionally increased.

The tactile detectability of the security feature can also be improved by calendering the substrate before laser-marking it. Thereby the security feature is produced in particularly smooth surroundings.

The production of a tangible marking by means of a laser, however, works better with rough surfaces, i.e. so as to be able to achieve a certain relief height, with rough surfaces less laser energy is necessary.

According to a further embodiment the security paper or document of value can also be exposed to the laser irradiation from the surface opposing the foil element. In this way the tangible marking is produced on the surface facing the laser. At the same time the metal layer of the foil element is ablated in the exposed area, so that the marking is visible also on the side of the foil element. Therefore, a kind of see-through register is the result.

According to a special embodiment the fibrous substrate of the document of value at least in a partial area of its surface is marked by means of laser radiation in such a way, that the fibers in the laser-marked partial area tangibly jut out over the surface of the substrate, so as to thereby constitute a tactilely detectable security feature.

The fibers of the security paper in the surface area usually run mainly in parallel to the surface of the security paper and are kept in this position by the sizing. Upon laser radiation the fibrous composite is broken up and single fiber ends are detached from the composite, so that the fibers due to their internal stress jut out over the substrate surface. Preferably, these fibers constitute a netting, which juts out over the substrate surface, this netting forming the tangible marking.

As particularly suitable fibrous substrate materials in this connection have proven cotton vellum paper and other cotton security papers, which compared to other papers possess long fibers with high tear strength. These types of paper in general are particularly suitable for security printing. Tests with cotton security paper using a Nd:YAG laser (wavelength 1064 nanometer) have lead to particularly good results, as already explained in detail.

In this embodiment of the invention, too, a coating on the surface of the substrate can be provided, through which the laser marking is effected. According to a first variant the coating is vaporized by means of laser radiation and the fiber structure of the fibrous substrate therebelow is broken up, so that the fibers jut out over the substrate surface. The coating can be, for example, a foil, in particular a hologram foil. The tactilely detectable, laser-marked partial area in this case is surrounded by an extremely smooth area, as a result of which the tactile detectability of the security feature is improved.

According to a second variant the coating consists of a layer not absorbing the laser radiation, in particular an areal print or a pattern print, such as for example a guilloche pattern. Such printed ink layers regularly are so thin, that by breaking up the fiber structure therebelow they break up, too, so that the fibers of the substrate again tangibly jut out over the substrate surface.

The not-absorbing layer can further be a surface-smoothing, in particular transparent, thin lacquer layer, which likewise is broken up by the fibres detached from the fiber structure. This variant, too, is characterized by an improved detectability of the tactile security feature within smooth surroundings.

As not-absorbing layer every thin coating is suitable, which upon the break-up of the fibrous composite is broken up by erecting fibers, irrespective of whether the coating is printed, vapor-deposited or sprayed.

It is particularly advantageous to admix additives to the not-absorbing layer, for example luminescence substances, which are visible only under special conditions, or which are only noticeable in the not-visible wavelength range, in particular in the UV region. Thereby, in addition to the tactilely detectable security feature a further security feature is integrated into the document of value in a particularly advantegous fashion, since due to the erecting fibers of the substrate and the break-up of the not-absorbing layer a particular contrast is achieved compared to the area of the not-absorbing layer surrounding the laser marking, which can be detected visually or with appropriate check devices.

According to a special embodiment the laser marking also leads to a colour change or a colour alteration of the marked partial area, as a result of which a clear increase in contrast for the purpose of checking by the human eye or by an image processing device is achieved.

This colour change is intensified, as explained above, preferably by suitable additives, which can be contained in the fibrous substrate. Depending on the kind of the selected additives the colour change is caused in a thermal way by the energy brought in with the laser radiation or by other wavelength-dependent colour alteration mechanisms. As additives in this example, too, laser iriodines of the Merck company are suitable. The thermally produced colour change can be additionally intensified by suitable absorbent substances. When the raised and tactile markings due to a colour alteration of the marked places can also be differentiated visually from their surroundings, this has the advantage that imitations by simple embossing are made more difficult, since the markings in this case would have to be printed in exact register, so as to have the respective colour contrast.

The tactilely perceptible marking can also be formed by an interaction of different mechanisms. The laser radiation alone can cause an inflating of the fibrous substrate or a break-up of the fiber structure. As described, the break-up of the fiber structure leads to a relief structure, which is formed by fibers that jut out over the substrate surface. Depending on the substrate material used or the laser parameters used, the tangible relief can also consist of a combination of the mentioned effects. Here the substrate material is inflated as well as at least partly broken up, so that individual fibers jut out over the substrate surface and form a netting interspersed by hollow spaces.

The step of the laser inscription can be effected at any stage of the manufacturing of the document of value. For example, it can be useful to provide the security paper with a respective marking as early as after the manufacturing in roll form. This in particular will be the case, when the security paper in an endless form is provided with a foil coating, such as a diffractively acting, for example strip-shaped security element, and this security element is to be provided with an inventive marking, as described above.

But preferably, the step of laser marking is effected as one of the last processing steps when producing the document of value. In case the documents of value are printed, for example, in the form of multiple-copy sheets, the laser marking can be effected on the sheet or on the already cut, finished document of value. The latter in particular is useful, when by means of the laser marking a tangible individual information, such as a serial number, is to be produced. If necessary, the lasered information in a last step again can be checked as to its correctness.

One particular advantage of the present invention in view of high security is the fact that the described effect cannot be imitated by simple means. The use of lasers requires large investments and a profound technical know-how, which by far exceeds the level of knowledge necessary for the use of usual printing machines or digital printing apparatuses.

A further advantage of the invention lies in the fact that the laser marking can be effected in a speed typically for printing works in a contactless fashion. In particular each document can be marked individually by, for example, integrating the serial number or another individualizing feature as a tactile security feature into the document of value. Particularly advantageous is an addition of additives, for example luminescence substances, to the coating or at least one of the layers of the coating or of the security element, which are visible only under special conditions or which are noticeable only in the not-visible wavelength range, in particular in the UV or IR region. By this means, additionally to the tactilely detectable security feature, a further security feature is integrated into the document of value.

Furthermore, it is also possible to provide a laser-absorbing coating, which is vaporized, and a not-absorbing layer one on top of the other on the fibrous substrate, the layer to be vaporized expediently being present as uppermost layer.

A further advantage of the invention is to be seen in the fact that with the help of the laser inscription for the first time tangible markings can be provided in the edge area of a document of value, in particular a bank note. Because up until now it was not desired to extend a tactile printed image produced by intaglio printing as far as into the edge area of the individual documents, since the printing operation is effected on the sheet and the cutting tools in this case would become smeared with colour. The inventive tangible marking, however, does not impede the cutting operation, so that the marking can be extended as far as into the edge to be cut. This has the advantage, that the tangible marking is immediately perceived as an authenticity feature, since bank notes mainly are touched at the edge.

BRIEF DESCRIPTION OF THE DRAWINGS

With the help of the following examples and additional Figures the advantages of the invention are explained. The described individual features and the embodiments described in the following are inventive when taken alone but also in combination. The examples represent preferred embodiments, to which the invention, however, shall be in no way restricted. The proportions shown in the Figures do not correspond to the dimensions present in reality and primarily serve for the improvement of clarity.

DETAILED DESCRIPTION OF THE INVENTION

Figure 1:
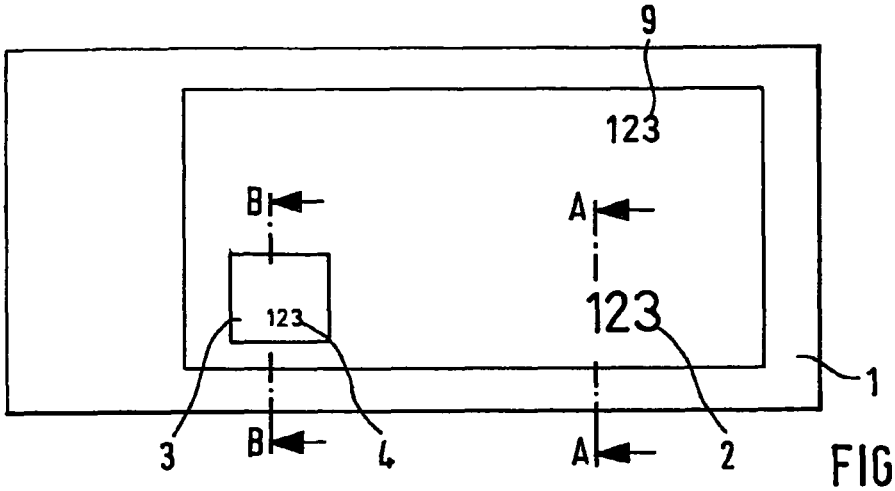
FIG. 1 shows an inventive document of value.

FIG. 1 shows an inventive document of value 1 in the form of a bank note. The document of value 1 according to the invention has a tangible marking 2 in the form of a relief structure, which is produced by the action of a laser beam. The shown example additionally has a security element 3 in the form of a patch, which for example can be a transfer element or a label with diffractively acting structures. Also in the area of the security element 3 is located an inventive tactile laser marking 4. The two laser markings 2, 4 in the shown example are identical in content. Furthermore, the security document has a further information 9, which is applied with the help of any other method, such as e.g. intaglio printing, ink jet or the like.

But the two laser markings 2, 4 can also be designed totally independent of each other or can be connected to each other in a certain way, which forms an additional authenticity feature. In this a way can be checked, whether the security element 3 in fact belongs to the document of value 1. Furthermore, one or the two laser markings can be connected with regard to any content to a different information disposed on the document of value, such as e.g. the information 9.

Of course, the security element 3 can have any other form. In certain embodiments it can be expedient, that the security element 3 has the form of a strip, which extends across the entire width or along the entire length of the document of value 1. It is also possible to provide merely one of the laser markings 2,4 on the document of value 1. Instead of the security element 3 a different kind of coating can be selected, such as e.g. a lacquer coating or a foil coating, or any printed image.

The document of value 1 beside the inventive tangible laser marking can also have further security features, such as for example a security thread, luminescent, electrically conductive, or magnetic security features.

Furthermore, the document of value 1 not necessarily has to be a bank note, it can be any other document made of paper substrate, such as for example a check, a security label, a visa, a passport page etc. Essential is, that one of the freely accessible components of the document of value consists of a fibrous paper substrate. This, preferably, is a pure cotton fiber paper or a mixture made of cotton and plastic fibers.

Figure 2:
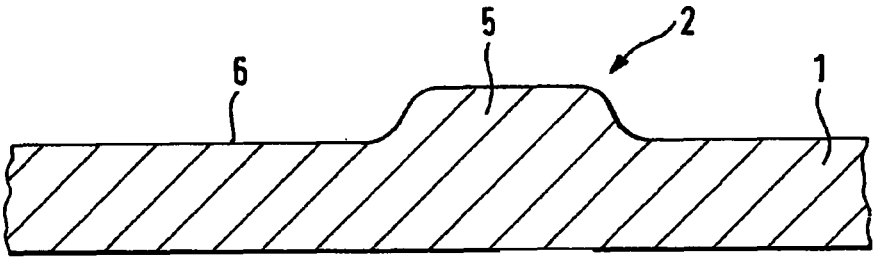
FIG. 2 shows the inventive document of value in cross section along the line A-A.

FIG. 2 shows a section through the document of value 1 along the line A-A. In the area of the laser marking 2 the paper of value has a tangible raised part 5, which is the result of the action of the laser beam. How much the raised part 5 juts out over the rest of the substrate surface 6, strongly depends on the laser energy used and the relative speed between document of value and laser beam during the inscription process.

The actual fiber structure in the marked area also strongly depends on the inscription parameters and the paper substrate used. With a paper made of cotton fibers, which is provided with a size layer, this size layer together with the calendering of the paper ensures a regular and to a first approximation solid surface.

Figure 3:
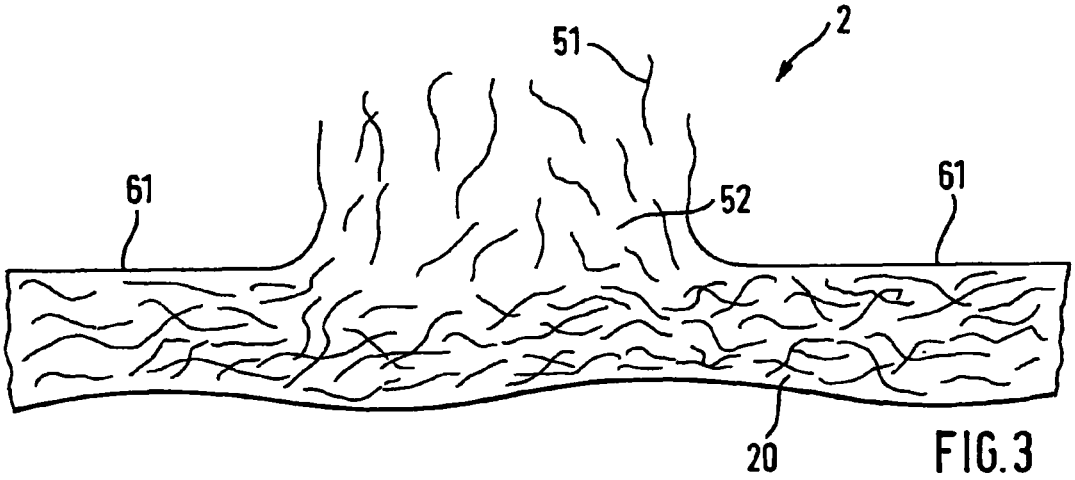
FIG. 3 shows a variant of the fiber structure of an inventive document of value.

FIG. 3 shows the surface area of such an inventive security paper 20 made of cotton fibers in the area of the laser marking 2. The entire shown detail of the security paper 20 is soaked by the size layer, which, however, for reasons of clarity is not shown. The area 61 of the security paper 20 for production reasons has a regular surface. In the area of the laser marking the sized surface is broken up and the fibrous composite is loosened up, i.e. between den fibers 51 hollow spaces 52 are formed which probably is due to the generation of gas. When the laser energy is appropriately high, a relatively wide-meshed netting of cotton fibers 51 is formed, which juts out over the surface 61 of the security paper 2, the cotton fibers 51 still being covered by the size layer.

Since the tangible raised part 5 can have a completely different appearance when using a different paper composition, the inventive tangible marking is merely schematically shown as a raised area 5.

Figure 4:
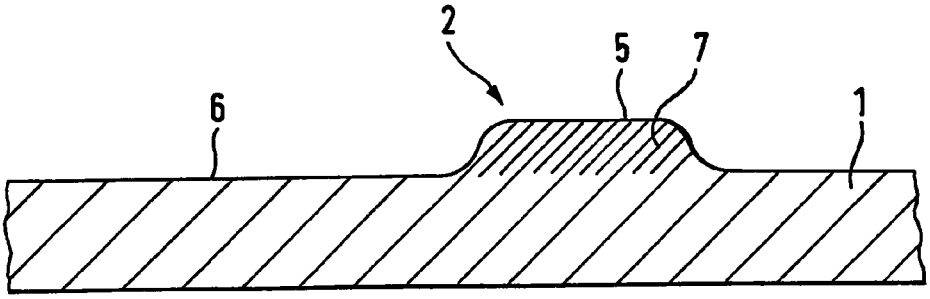
FIG. 4 shows a further embodiment of the inventive document of value in cross section along the line A-A.

In FIG. 4 likewise a section through the document of value 1 along the line A-A is shown. Here, however, by the action of the laser beam beside the raised part 5 was produced a colour alteration, in particular a blackening 7, of the document of value material. Whether and how deep the colour alteration or blackening 7 is present in the document of value material 1, also strongly depends on the inscription parameters and the composition of the security paper used for the document of value 1.

Figure 5:
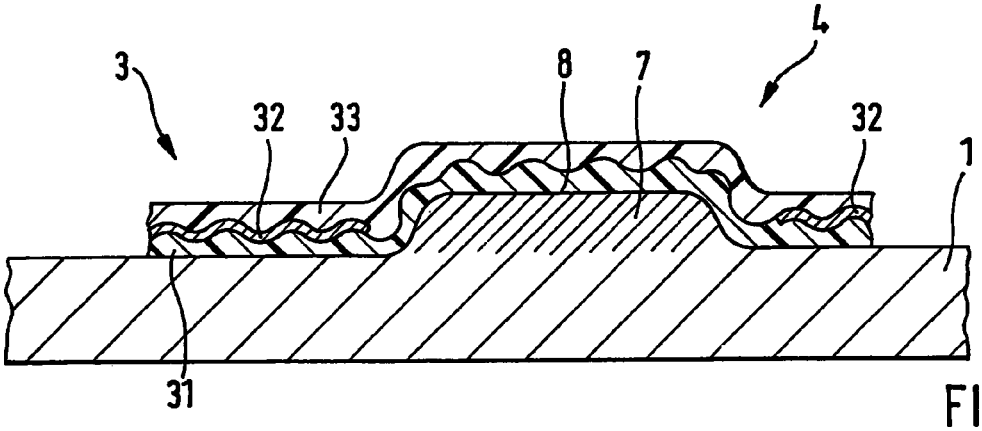
FIG. 5 shows a section of the inventive document of value along the line B-B.

FIG. 5 shows a section through the document of value 1 along the line B-B. In this case in the area of the laser marking 4 is disposed a coating in the form of a security element 3, the security element 3 consisting of a transfer element. The transfer element is fastened to the document of value 1 by means of an adhesive layer 31. Between the adhesive layer 31 and a plastic layer, in particular lacquer layer 33, is located a metal layer 32. This metal layer 32 is missing in the area of the laser marking 4. During the inscription process with the laser the metal layer 32 is vaporized and/ or disintegrated and is no longer visible. The colour alteration 7 caused by the laser inscription, therefore, is visible through the lacquer layer 33 and the adhesive layer 31. The inscription parameters can be adjusted in such a way, that the area, in which the metal layer 32 is removed, is larger than the partial area provided with the tangible marking 8. Thus the visible colour alteration or blackening produced by the laser is surrounded by a transparent area.

In the shown example the plastic layer 33 and the adhesive layer 31 are hardly damaged or not damaged by the laser. Depending on the inscription parameters used, one layer or the two layers can be removed partially or completely.

Instead of with the transfer element the fibrous substrate can be equipped with a transparent or pigmented ink layer. Essential in this connection is that the ink layer does not absorb the laser radiation used for the laser marking. The ink layer can be applied to the substrate in any fashion, for example by printing. Particularly advantageous is an ink layer, which renders a smooth impression of the substrate surface. Within this meaning the term "ink layer" also includes a dirt-repellent, optionally transparent, coating or protective lacquer coat.

Since the ink layer does not absorb the laser radiation used, the absorption of the laser energy does not take place until in the substrate layer. In this way the raised part 5 is produced the substrate, so that a tangible marking within the ink layer is the result.

Preferably, the not-absorbing ink layer contains dyes, which only under certain conditions become visible, such as for example luminescence dyes, or which possess properties, which are not visible for the human eye, for example substances shining in the infrared region or in the UV region.

The ink layer has not to be applied all-over. It can also be a colour pattern, in particular one of the guilloche patterns often used in security printing. The only requirement is that the ink layer of the pattern is to a far extend transparent for the laser radiation used.

Figure 6:
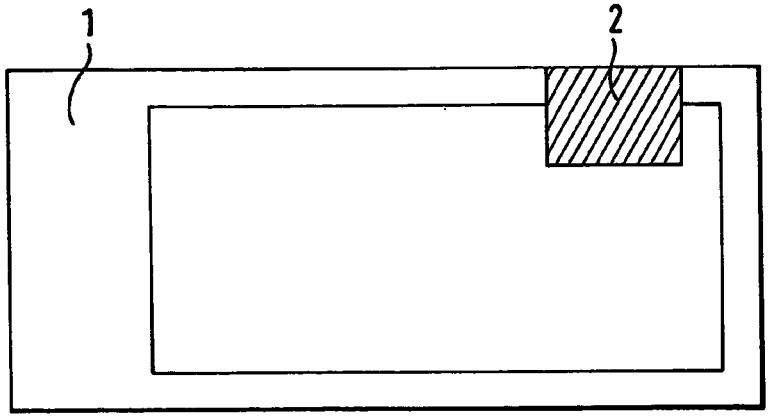
FIG. 6 shows an inventive document of value with an inventive marking disposed in the edge area.

FIG. 6 shows a further embodiment of the inventive document of value 1 in a top view. In this case the tangible marking 2 extends as far as into the edge area of the document of value 1. Since the bank notes, when manually processed but also in normal payment transactions, mainly are touched at the edge, the arrangement of the tactile security element in the edge area has the advantage, that the security element can be checked very simple and fast. Other tactile authenticity features, such as for example a tactile intaglio printing, cannot or only with difficulties be disposed in the edge area of the document of value 1, since the documents of value are printed in sheets with several copies and subsequently are cut into the single copies. When disposing the intaglio printing element in the edge area, however, there exists the danger of the cutting tools becoming smeared with colour while cutting the sheets into single copies.

FIG. 7 to 10 show different embodiments of the tactile laser marking 2 in a single-layer security paper 100.

Figure 7:
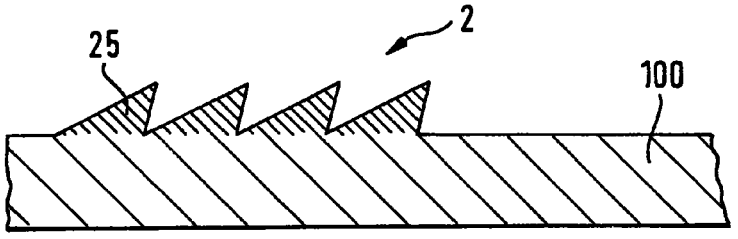
FIG. 7 shows a variant of the inventive document of value in cross section.

In FIG. 7 different laser parameters, in particular laser energies, are used, so as to produce a tangible saw-tooth relief 25. This embodiment has the advantage that depending on the stroking direction it feels different when stroking from the left to the right compared to stroking from the right to the left. This feature can be used as an additional security feature. The different laser energies used also lead to a different blackening effect, which is visually noticeable. The individual saw teeth thus have different shades of grey.

Figure 8:
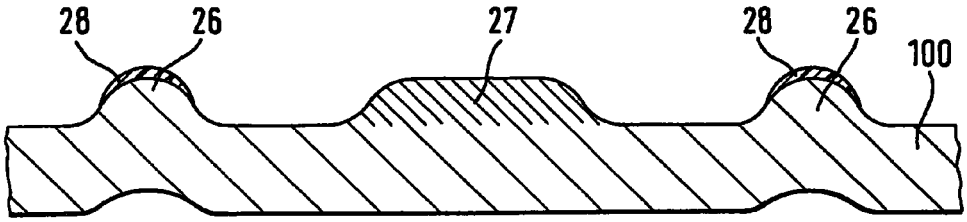
FIG. 8 shows a further variant of the inventive document of value in cross section.

In FIG. 8 a security feature is described, which consists of a combination of a tactile intaglio printing element and an inventively produced tangible laser marking. In the shown example the tangible intaglio printing marking 26 forms an edge area enclosing the tangible laser marking 27. In intaglio printing the security paper 100 is pressed into the intaglio printing plate, so that the paper is formed in this area. At the same time the paper receives the ink 28 in the embossed area. The tactile effect of the intaglio printing marking 26, therefore, results from the embossing as well as the high inking 28 in the embossed area. This kind of marking forms steep flanks, and as a hard, abruptly sloping element in terms of tactility it can be distinguished very well from the soft, nearly velvety laser marking 27.

Figure 9:
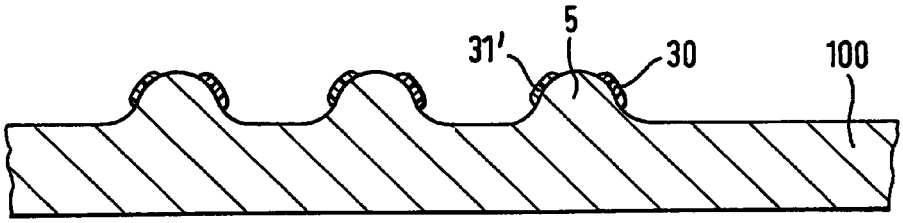
FIG. 9 shows a further variant of the inventive document of value in cross section.

In FIG. 9 a security paper is shown, which in a first step was printed with coloured line patterns 30, 31. Subsequently, the borderline area between the printed lines 30, 31 is inventively inscribed with the help of a laser, so that a tangible relief is the result. By the bulging out of the security paper in the area 5 the lines 30, 31 are shifted onto the flanks of the raised areas 5. This combination of printed lines 30, 31 and raised areas 5 forms an optically variable security element, which dependent on the viewing direction renders different visual impressions. If, for example, the lines 30 are lines with a first colour and the lines 31 are lines with a second colour, and when viewed from an oblique angle from the left, merely the coloured lines 31 of the second colour will be noticeable. The security element, therefore, appears in this second colour. The lines 30 due to the shadowing effects are not noticeable. When viewed from an oblique angle from the right, however, the lines 31 are shadowed, so that ideally merely the coloured lines 30 are noticeable. The security element thus appears in the first colour. Here the printed and lasered lines not necessarily have to form an exact raster; it is sufficient, when the effect is formed by a part of the printed lines.

Figure 10:
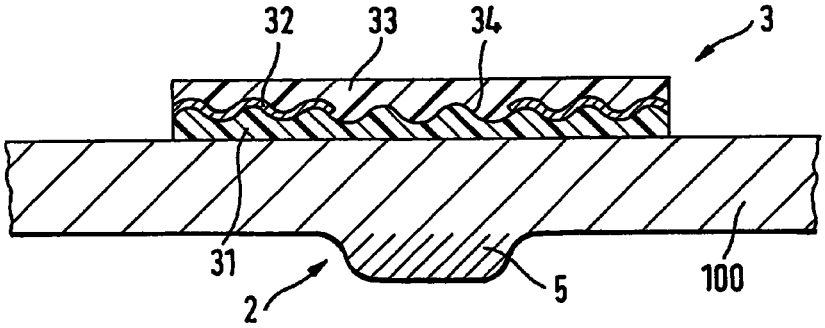
FIG. 10 shows a further variant of the inventive document of value in cross section.

FIG. 10 shows a further embodiment of the inventive security element 100. In this example on a surface of the security paper 100 a security element 3 is disposed as already described in connection with FIG. 5. This security element consists of an adhesive layer 31, a diffraction structure 34 and a reflection layer 32 and a protection layer 33. This security paper 100 on the opposite surface is provided with an inventive laser marking 2. Here the laser energy and the other laser parameters are adjusted in such a way, that a raised marking 5 is formed and at the same time the originally continuous metalization 32 of the security element 3 in the area exposed to the laser is destroyed. I.e., the security element 3 in the area exposed to the laser radiation is transparent, so that the blackening produced at the same time as the raised marking 5 is visible through this transparent area. In contrast to the example shown in FIG. 5 the inventive raised part 5, however, is located on the side opposite to the security element 3 and is practically not tangible on the surface of the security element 3.

The embodiments can also be combined with each other by disposing the ink layer on the surface of the substrate and then a foil material thereabove. At first the foil material is vaporized with the laser, and the ink layer located below the foil is uncovered. By further action of the laser the tangible marking 5 emerges in the substrate, as explained above.

When the foil material has the form of an opaque foil, for example a metalized plastic foil, the laser marking 5 also produces a clearly visible contrast which is due to the ink layer located therebelow that has been uncovered.

In case in the area of the laser marking an ink layer is disposed, the fibers jutting out over the substrate surface produce a clear contrast compared to the surroundings, which is detectable with suitable check devices. This effect therefore is suitable for the automatic testing by machine.

Figure 11:
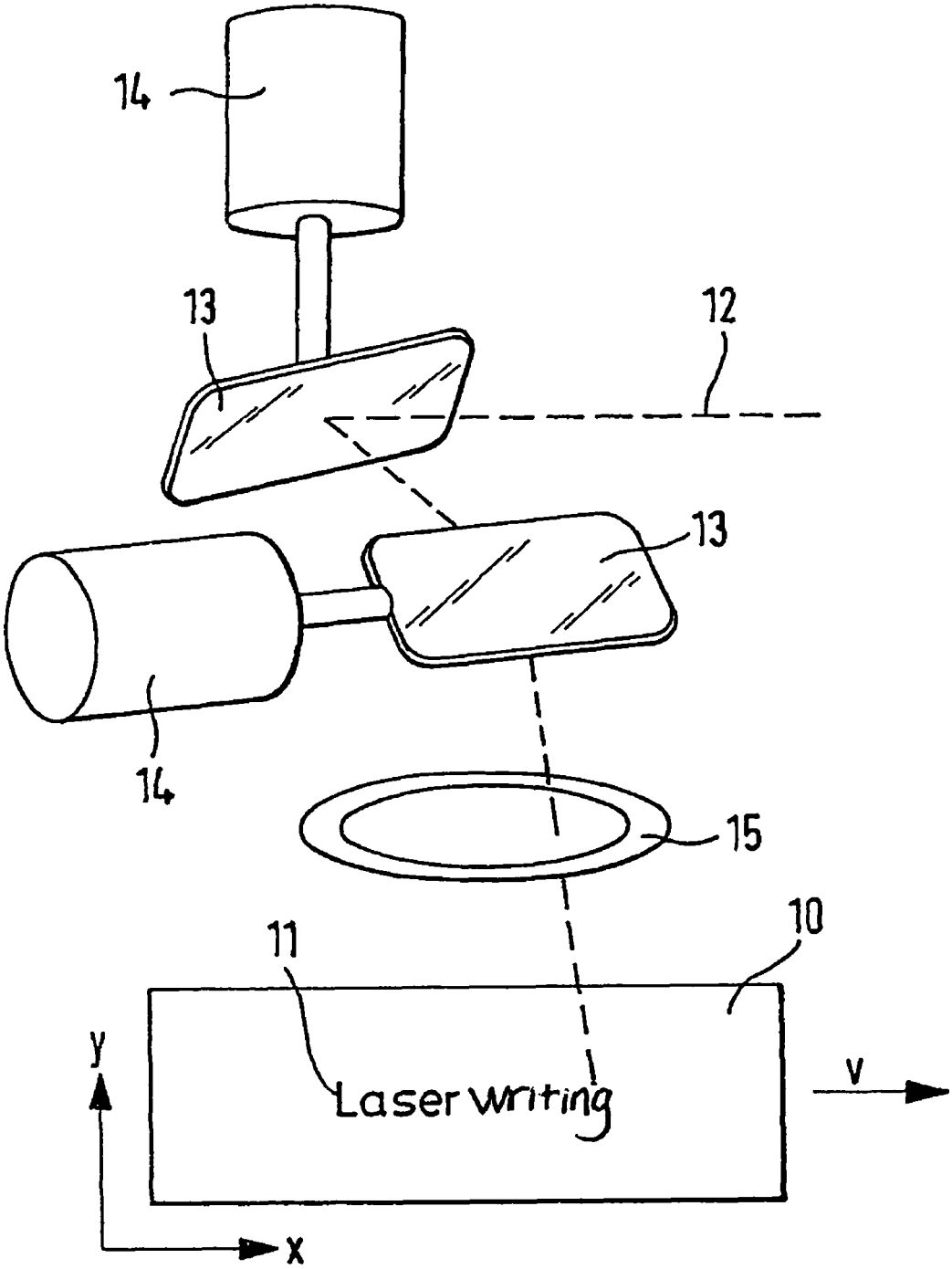
FIG. 11 shows a schematic representation of a laser-scanner writing apparatus.

FIG. 11 schematically shows a laser scanner, with which a substrate 10 is provided with a laser marking 11. The substrate 10 can be a ready cut document of value, a sheet with several copies of a document of value or a security paper in an endless form.

A laser beam 12 is deflected via two mirrors 13, which are driven by galvanometer 14, one mirror 13 being responsible for the x- and the other mirror 13 for the y-direction. In a plane field lens 15 the laser beam 12 is focussed onto the surface of the substrate 10 and produces the marking 11. The substrate 10 is adapted to move with the speed v during the marking process. This speed v is recorded by the sensors and transmitted to a computer, so as to control the galvanometer 14 via the computer in such a way that the speed v is compensated. This marking method, therefore, can be employed particularly advantageous for a contactless marking of documents of value, which, as usual in printing works, are processed in a high-speed fashion.

The substrate 10 can also be marked by other methods, for example, by means of a matrix of point-shaped exiting laser beams or by means of beams of a larger profile, which are partially covered by a template. Such templates can be designed as to be automatically variable. In case a respective movement of the radiation according to the speed v is not possible or not desired, the moving substrates can be marked with a short exposure time. A beam control by polygonal mirrors is also possible.

As radiation sources $CO_2$ lasers, Nd:YAG lasers or other laser types are possible depending on the lasered substrate, for example also those lasers, which are adapted to work with double or triple frequency just as Nd:YAG lasers.

By a variation of the inscription parameters, such as for example laser power, exposure time, working mode of the laser etc. the marking results can be varied. I.e. the raised parts produced by the laser can be respectively varied in their height. Preferably, the tangible marking has a height of 30 to 100 μm. Furthermore, it is necessary to adjust the composition of the paper to the laser radiation or laser power used.

The markings for example are carried out with a Nd:YAG laser, the fundamental wavelength of which is 1064 nanometer and which has an average power of 26 W and a modulation frequency of 8 kilohertz. The diameter of the laser beam impinging on the substrate (spot dimension) measures about 100 μm and the traverse speeds of the laser beam over the substrate lie between 250 and 1000 millimeter per second. The typical height of an inventive marking produced therewith ranges between 30 and 80 μm. In individual cases, i.e. in particular with low traverse speeds, clearly greater values were achieved, for example, a height of more than 100 μm at 250 millimeter per second. The width of the markings can vary between 0.2 and 0.6 millimeter.

For a calendered cotton vellum paper with a density of 90 gram per square meter, for example, at an inscription speed of 330 millimeter per second tangible markings with an average relief height of 70 μm and a line width of about 500 μm are the result. With an inscription speed of 675 millimeter per second, however, the highest achievable relief height merely is 40 μm with the same line width.

For a paper made of a mixture of cotton and plastic fibers with a plastic fiber proportion of 12.5 wt. % and a weight per unit area of 90 gram per square meter (so-called Synthek paper) the dimensions of the marking produced with 250 millimeter per second are 65 μm average height and about 0.5 millimeter average width. When increasing the traverse speed to 1000 millimeter per second, the dimensions are 35 μm average height and 0.3 millimeter average width.

Figure 12:
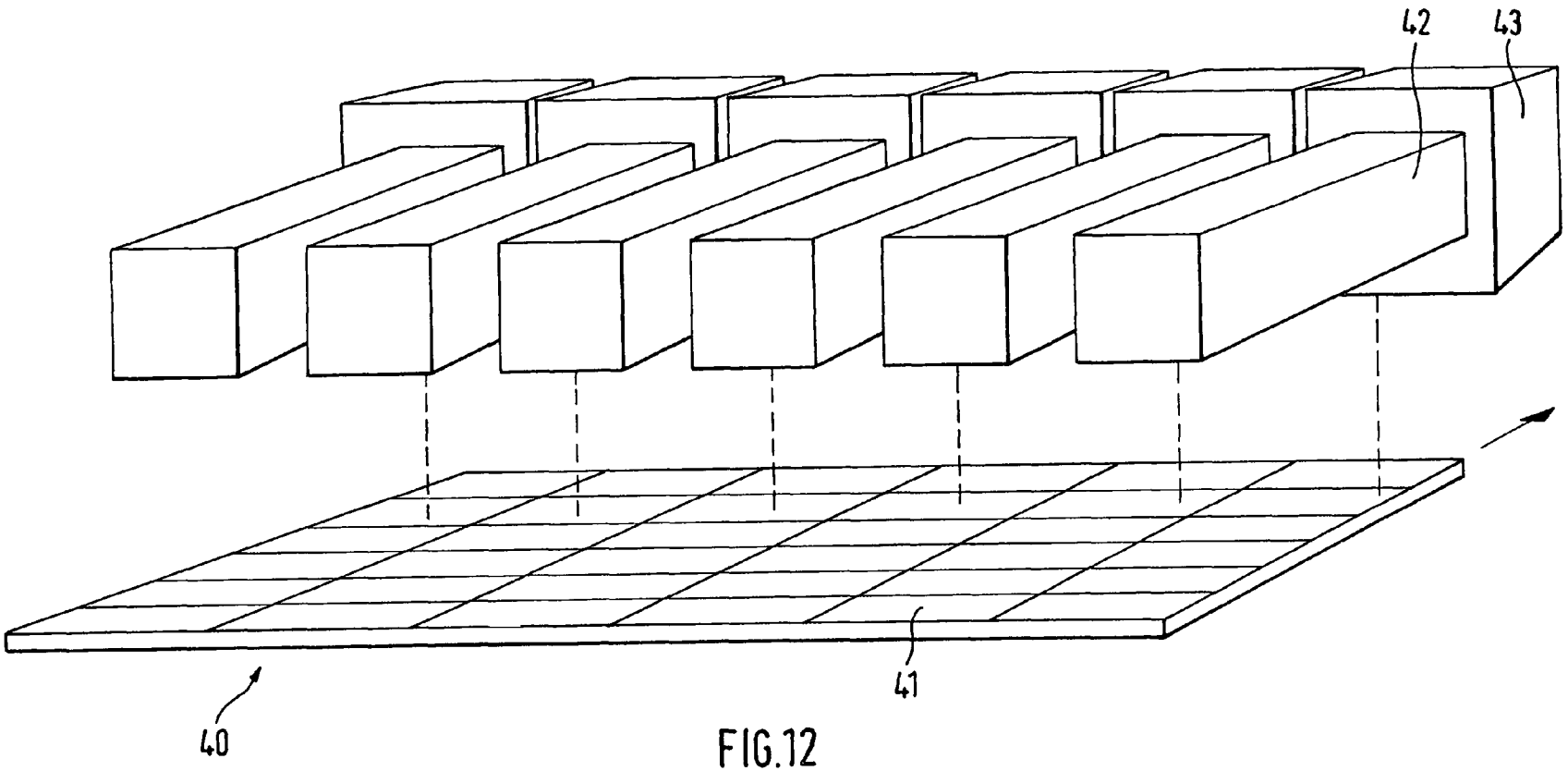
FIG. 12 shows a schematic representation of a laser inscription apparatus for the inscription of a document of value sheet.

FIG. 12 shows an embodiment of the inventive apparatus, in which a sheet 40 is simultaneously provided with inventive markings with the help of a multitude of lasers. In the shown case the sheet 40 has six columns and six rows, i.e., on this sheet 40, thirty (36) single copies 41 of documents of value are disposed. For each column a laser tube 42 is disposed above the printing sheet, the said laser tube 42 providing the single copies 41 disposed in the respective column with the inventive marking. With the help of this arrangement the throughput can be strongly increased, because one single laser beam needs not to be moved over the entire printing sheet, and instead only one movement in parallel to the columns of the printing sheet is required. The inscription of the individual copies is effected via a deflection of the laser radiation by means of mirrors, which in the shown example are not represented. Additionally, the lasers can be provided with a scanning head 43.

The invention claimed is:

1. Document of value, comprising:

a security paper having at least one tangible marking in the form of a raised relief structure;

wherein the relief structure is formed from cotton fibers of the security paper and is produced by a laser, and wherein the raised relief structure comprises loosened cotton fibers and hollow spaces.

2. Document of value according to claim 1, characterized in that the document of value in the area of the tangible marking has a visually noticeable colour alteration.

3. Document of value according to claim 1, characterized in that the security paper in the area of the tangible marking is blackened.

4. Document of value according to claim 1, characterized in that the colour alteration is produced with the laser.

5. Document of value according to claim 1, characterized in that the tangible marking has a relief height of 30 μm to 100 μm.

6. The document of value of claim 5, wherein said tangible marking has a relief height of between 30 μm to 80 μm.

7. Document of value according to claim 1, characterized in that the security paper contains additives at least in certain areas, which intensify at least one of the colour alteration or relief formation.

8. Document of value according to claim 1, characterized in that the security paper contains at least proportions of fibers of annual plants.

9. The document of value of claim 8, wherein said fibers of annual plants comprise at least one of cotton, linter, or flax.

10. Document of value according to claim 1, characterized in that the security paper includes a mixture of cotton fibers and plastic fibers.

11. Document of value according to claim 1, characterized in that the relief structure of the marking has at least one of different relief heights or degrees of blackening.

12. Document of value according to claim 1, characterized in that the tangible marking is present in the form of alphanumeric characters, bar codes, patterns or microwriting.

13. Document of value according to claim 1, characterized in that several tangible markings are present on the document of value.

14. Document of value according to claim 1, characterized in that several tangible markings are present on the document of value that are connected to each other with regard to content.

15. Document of value according to claim 1, characterized in that the tangible marking is connected to a different information on the document of value with regard to content.

16. Document of value or security paper according to claim 1, characterized in that the document of value or security paper has a coating and that the tangible marking is at least partially disposed in the area of this coating.

17. Document of value or security paper according to claim 16, characterized in that the coating is a multilayer security element.

18. Document of value or security paper according to claim 17, characterized in that the security element has at least one plastic layer and one metal layer, at least the metal layer at least in the area of the tangible marking being removed by the action of the laser.

19. Document of value or security paper according to claim 18, characterized in that the plastic layer has a diffraction structure.

20. Document of value or security paper according to claim 18, characterized in that the area, in which the metal layer is removed, is larger than the area provided with a tangible marking.

21. Document of value or security paper according to claim 16, characterized in that the coating is a print.

22. Document of value or security paper according to claim 21, characterized in that the print and the tangible marking are disposed to each other in such a way, that an optically variable element is the result.

23. Document of value or security paper according to claim 1, characterized in that the document of value or security paper has a junction between paper and foil and that the tangible marking extends beyond the paper/foil borderline area.

24. Document of value or security paper according to claim 1, characterized in that the document of value or security paper has a multilayer form.

25. The document of value of claim 1, comprising a bank note.

26. Security paper for documents of value, comprising at least one tangible marking in the form of a raised relief structure formed from cotton fibers of the security paper, that is produced by laser, wherein the raised relief structure comprises loosened cotton fibers and hollow spaces.

27. The security paper of claim 26, wherein said documents of value are bank notes or ID cards.

28. Method for producing a tangible marking in a document of value, which includes a security paper characterized in that the security paper is exposed to the radiation of a laser, and that the inscription parameters of the laser and the composition of the security paper are adjusted to each other in such a way, that the result is the tangible marking in the form of a raised relief structure that is formed from cotton fibers of the security paper, wherein the raised relief structure comprises loosened cotton fibers and hollow spaces.

29. Method according to claim 28, characterized in that the inscription parameters are selected in such a way, that in addition to the tangible marking a visually noticeable colour alteration of the security paper is the result.

30. Method according to claim 28, characterized in that the security paper is blackened by the laser radiation in the area of the tangible marking.

31. Method according to claim 28, characterized in that the inscription parameters of the laser are adjusted in such a way, that at least one of different relief heights or degrees of blackening in the security paper are the result.

32. Method according to claim 28, characterized in that a coating is applied to the document of value or security paper before the inscription with the laser, and the tangible marking is at least partially produced in the area of this coating.

33. Method according to claim 28, characterized in that a multilayer security element is applied as a coating with the help of the transfer method.

34. Method according to claim 28, characterized in that a Nd:YAG laser is used.

35. Method according to claim 28, characterized in that the inscription with the laser is effected in a high-speed fashion as usual for security printing works.

36. The method of claim 28, wherein said document of value comprises a bank note.

* * * * *